US008244523B1

(12) United States Patent
Murphy

(10) Patent No.: US 8,244,523 B1
(45) Date of Patent: Aug. 14, 2012

(54) SYSTEMS AND METHODS FOR NOISE REDUCTION

(75) Inventor: Ryan M. Murphy, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 733 days.

(21) Appl. No.: 12/420,673

(22) Filed: Apr. 8, 2009

(51) Int. Cl.
*G10L 19/14* (2006.01)
*G10L 19/02* (2006.01)
*G10L 19/00* (2006.01)

(52) U.S. Cl. ..... 704/205; 704/226; 704/500; 381/71.11

(58) Field of Classification Search ..... None
See application file for complete search history.

(56) References Cited

U.S. PATENT DOCUMENTS

| | | | | |
|---|---|---|---|---|
| 5,148,488 | A * | 9/1992 | Chen et al. | 704/219 |
| 5,826,230 | A * | 10/1998 | Reaves | 704/233 |
| 6,324,502 | B1 * | 11/2001 | Handel et al. | 704/226 |
| 6,351,731 | B1 * | 2/2002 | Anderson et al. | 704/233 |
| 6,408,269 | B1 * | 6/2002 | Wu et al. | 704/228 |
| 6,463,411 | B1 * | 10/2002 | Li et al. | 704/226 |
| 7,072,833 | B2 * | 7/2006 | Rajan | 704/233 |
| 7,890,319 | B2 * | 2/2011 | Garner | 704/200 |
| 2002/0026253 | A1 * | 2/2002 | Rajan | 700/94 |
| 2005/0276363 | A1 * | 12/2005 | Joublin et al. | 375/350 |
| 2009/0076814 | A1 * | 3/2009 | Lee | 704/233 |

OTHER PUBLICATIONS

Kalman, "A New Approach to Linear Filtering and Prediction Problems", Transactions of the ASME-Journal of Basic Engineering, 82 (Series D): 35-45, 1960.*
Weiss et al., "DySANA: Dynamic Speech and Noise Adaptation for Voice Activity Detection", In Proceedings of Interspeech'2008. pp. 127-130, 2008.*
Fujimoto et al., "Noise Robust Voice Activity Detection Based on Switching Kalman Filter", In Processings of Interspeech'2007. pp. 2933-2936, 2007.*
Fujimoto et al., "Noise Robust Voice Activity Detection Based on Statistical Model and Parallel Non-Linear Kalman Filtering", IEEE International Conference on Acoustics, Speech and Signal Processing, ICASSP-2007, 2007.*
Fujimoto et al., "Noisy Speech Recognition Using Noise Reduction Method Based on Kalman Filter", IEEE International Conference on Acoustics, Speech, and Signal Processing, ICASSP '00, vol. 3, pp. 1727-1730, 2000.*
Gannot et al., "Iterative and Sequential Kalman Filter-Based Speech Enhancement Algorithms", IEEE Transactions on Speech and Audio Processing, vol. 6, No. 4, Jul. 1998.*
Moghaddamjoo et al., "Robust Adaptive Kalman Filtering with Unknown Inputs", IEEE Transactions on Acoustics, Speech, and Signal Processing, vol. 37, No. 8, Aug. 1989.*

(Continued)

*Primary Examiner* — Brian Albertalli
(74) *Attorney, Agent, or Firm* — Donna P. Suchy; Daniel M. Babrbieri

(57) ABSTRACT

An apparatus is shown for detecting speech in an audio signal obtained from an input device, the audio including speech and noise. The apparatus includes a processing circuit which includes a filter configured to smooth the audio signal. The processing circuit is configured to control the bandwidth of the filter based on characteristics of the audio signal and to provide a smoothed signal obtained from the filter to a voice activity detector configured to determine whether the smoothed signal represents speech.

20 Claims, 11 Drawing Sheets

OTHER PUBLICATIONS

Fujimoto et al., "Speech Recognition in a Noisy Environment Using a Speech Signal Estimation Method Based on the Kalman Filter", Systems and Computers in Japan, vol. 35, No. 3, 2004.*

Cappe, Olivier, Elimination of the Musical Noise Phenomenon with the Ephraim and Malah Noise Supressor, IEEE Transactions on Speech and Audio Processing, vol. 2, Issue 2, Apr. 1994, pp. 345-349.

Cohen, Israel, Noise Spectrum Estimation in Adverse Environments: Improved Minima Controlled Recursive Averaging, IEEE Transactions on Speech and Audio Processing, vol. 11, No. 5, Sep. 2003, pp. 466-475.

Ephraim et al., Speech Enhancement Using a Minimum Mean-Square Error Log-Spectral Amplitude Estimator, IEEE Trans. ASSP, vol. 33, pp. 443-445, Apr. 1985.

Ephraim et al., Speech Enhancement Using a Minimum Mean-Square Error Short-Time Spectral Amplitude Estimator, IEEE Trans. ASSP, vol. 32, pp. 1109-1121, Dec. 1984.

Malah et al., Tracking Speech-Presence Uncertainty to Improve Speech Enhancement in Non-Stationary Noise Environments, 1999, pp. 789-792.

Martin, et al., A Noise Reduction Preprocessor for Mobile Voice Communication, EURASIP Journal on Applied Signal Processing, 2008, pp. 1046-1058.

Martin, R. Noise Power Spectral Density Estimation Based on Optimal Smoothing and Minimum Statistics, IEEE Trans. Speech Audio Process, vol. 9, No. 5, pp. 504-512, Jul. 2001.

McAulay et al., Speech Enhancement Using a Soft-Decision Noise Suppression Filter, IEEE Trans. ASSP, vol. ASSP-28, No. 2, pp. 137-145, Apr. 1980.

Loizou, Philipos C., Speech Enhancement: Theory and Practice, © 2007.

Zarchan et al., Fundamentals of Kalman Filtering: A Practical Approach, Second Edition, © 2005.

* cited by examiner

SYSTEMS AND METHODS FOR NOISE REDUCTION

BACKGROUND

The present disclosure relates generally to the field of audio systems. More specifically, the present disclosure relates to noise reduction in an audio system.

Mobile voice applications, such as cellular phones, voice recognition systems, military radio applications and other single microphone devices, are prone to degradation from environmental noise. The quality of speech is deteriorated even further when these devices incorporate a low bit rate speech encoding algorithm that operates by modeling the vocal parameters of human speech and encoding them into packets of specific lengths. These packets are then transmitted over a desired radio channel using some designated type of modulation. On the receiving end the signal is demodulated, decoded, and the resulting reconstructed speech waveform is sent to an audio device where it is played. As a result, the magnitude and type of noise at the transmitting microphone can severely degrade the quality of speech generated by the model. Therefore, it has been discovered that the addition of a noise reduction algorithm before the speech encoding routine can greatly improve the quality of the reconstructed voice.

Many algorithms have been designed that attempt to improve the quality of speech communication by removing the effects of additive noise. A large number of these methods work in the frequency domain by calculating frequency specific attenuation parameters and applying them to respective discrete Fourier transform bins. However, the majority of these algorithms were developed under the assumption that speech is inherently present in every frequency region. Therefore, it has been shown that the quality can be improved if the spectral gain function utilizes a soft-decision attenuation parameter calculation based on the probability of speech presence. Many of these procedures excel at reducing the effects of stationary noise, but are challenged when confronted with nonstationary noise environments such as inside an airplane cockpit, a helicopter, a tank, another moving vehicle, or a noisy room.

Removing additive noise from a speech signal has numerous benefits (enhancement of the quality of mobile voice communications, improved speech recognition, etc). Over the years, many methods have been developed that attempt to remove noise from the signal. These methods range from spectral subtraction, Weiner filtering, maximum likelihood estimation (ML), minimum mean squared error (MMSE), subspace algorithms, and many others. In the end, the overall performance of all of these methods rests on an accurate estimate of the noise power spectral density. Specifically, noise overestimation can cause speech distortion, while underestimation can cause residual and musical noise. Some noise estimation techniques assume that the spectral characteristics of the noise change slowly with regards to the speech signal and attempt to estimate the noise during periods of speech pause.

SUMMARY

One embodiment of the invention relates to a method for detecting speech in an audio signal obtained from an input device, the audio including speech and noise. The method comprises providing the audio signal to a filter configured to smooth the audio signal. The method further comprises controlling the bandwidth of the filter based on characteristics of the audio signal. The method further comprises obtaining a smoothed signal from the filter and providing the smoothed signal to a voice activity detector configured to determine whether the smoothed signal represents speech.

Another embodiment relates to an apparatus for detecting speech in an audio signal obtained from an input device, the audio including speech and noise. The apparatus includes a processing circuit which includes a filter configured to smooth the audio signal. The processing circuit is configured to control the bandwidth of the filter based on characteristics of the audio signal and to provide a smoothed signal obtained from the filter to a voice activity detector configured to determine whether the smoothed signal represents speech.

Another embodiment relates to a computer program product which includes computer usable medium having computer readable program code embodied therein. The computer readable program code is adapted to be executed to implement steps including: obtaining an audio signal from an input device, the audio signal including speech and noise and providing the audio signal to a filter configured to smooth the audio signal. The steps further include controlling the bandwidth of the filter based on characteristics of the audio signal, and obtaining a smoothed signal from the filter and providing the smoothed signal to a voice activity detector configured to determine whether the smoothed signal represents speech.

BRIEF DESCRIPTION OF THE FIGURES

The invention will become more fully understood from the following detailed description, taken in conjunction with the accompanying drawings, wherein like reference numerals refer to like elements, in which.

DETAILED DESCRIPTION OF THE EXEMPLARY EMBODIMENTS

Figure 1:
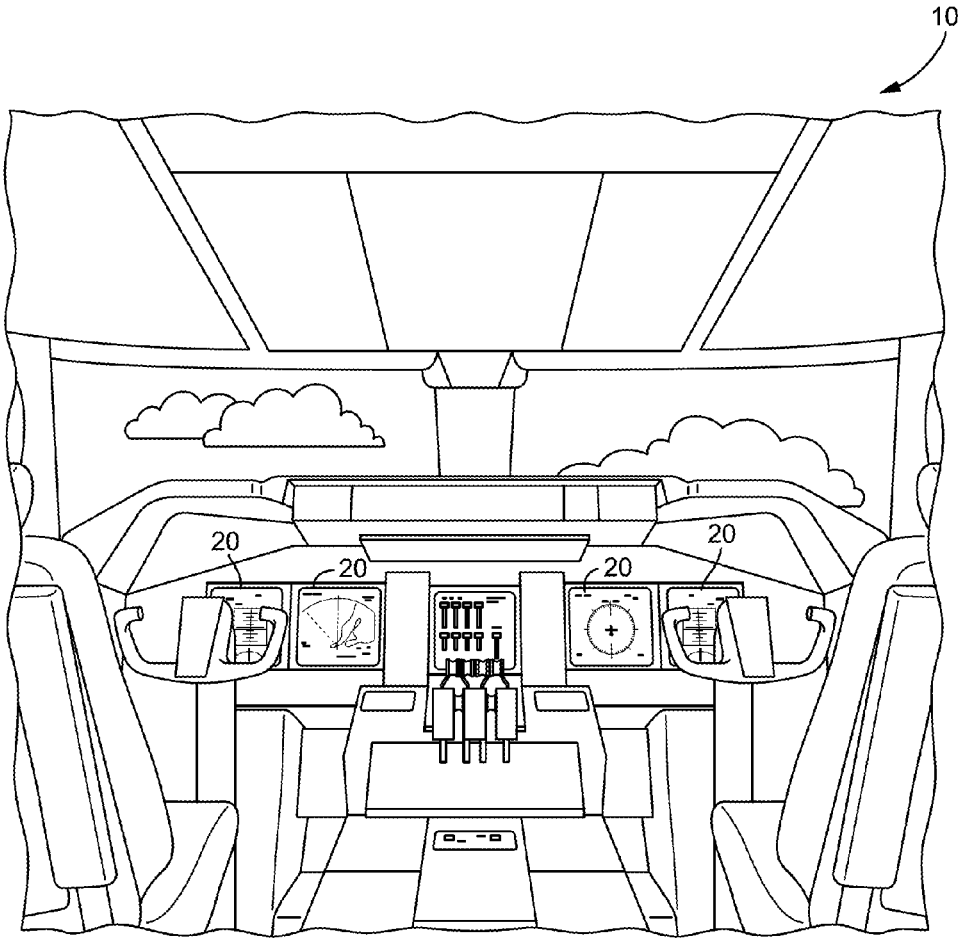
FIG. 1 is an illustration of an aircraft control center, according to an exemplary embodiment.

Before describing in detail the particular improved system and method, it should be observed that the invention includes, but is not limited to, a novel structural combination of conventional data/signal processing components and communications circuits, and not in the particular detailed configurations thereof. Accordingly, the structure, methods, functions, control and arrangement of conventional components software, and circuits have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

Referring generally to the figures, systems and methods for reducing noise in an audio signal that may include voice are shown. The systems and methods described herein may generally adapt quickly to sudden changes in noise, improving the probability that noise will accurately be identified and reduced or removed. The systems and methods can utilize two Kalman filters: a first Kalman filter for smoothing the noisy speech power spectral density (NSPSD) and a second Kalman filter used for estimating the noise power spectral density (NPSD). The systems and methods adaptively control the bandwidth of the first Kalman filter to improve performance of the noise reduction system. More particularly, the systems and methods described herein change the bandwidth of the first Kalman filter by controlling the measurement noise and/or the process noise. This adaptive control advantageously allows the voice activity detector to quickly track transitions between noise and speech frames. It further provides an improved estimate of speech power which can result in reduced clipping of speech in low signal-to-noise ratios situations and accurate tracking of the speech spectral peaks and valleys, which improves the NPSD estimate.

Referring to FIG. 1, an illustration of an aircraft control center or cockpit 10 is shown, according to one exemplary embodiment. Aircraft control center 10 includes various modules 20 such as flight displays and audio input and output devices (e.g., a microphone, speakers). According to an exemplary embodiment, the systems and methods of the present disclosure may be used in an aircraft. According to other various exemplary embodiments, the systems and methods of the present disclosure may be implemented in, for example, a space vehicle, a ground vehicle, a non-vehicle application, or any other application.

Figure 2A:
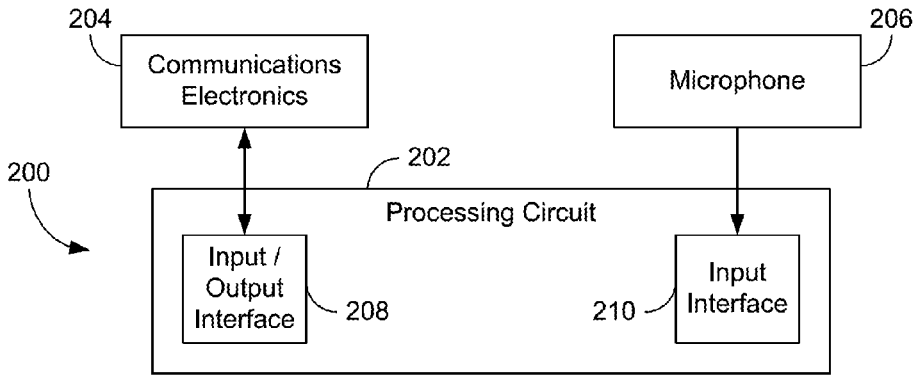
FIG. 2A is a block diagram of an audio system that may be used with the systems and methods of the present disclosure, according to an exemplary embodiment.

FIG. 2A is a block diagram of an audio system 200 that may be used with the systems and methods of the present disclosure, according to an exemplary embodiment. Audio system 200 generally includes a processing circuit 202, communications electronics 204 for receiving and sending audio information, and a microphone 206 for receiving audio from the environment in which the microphone is located. Processing circuit 202 may include a microprocessor, an application specific integrated circuit (ASIC), a circuit containing one or more processing components, a group of distributed processing components, or other hardware configured for processing. Processing circuit 202 is shown to include an input/output (I/O) interface 208 for receiving an input from communications electronics 204 and for providing an output via the communications electronics 204. Processing circuit 202 additionally includes an input interface 210 for receiving an input from microphone 206 (or another audio input device or other external electronics which may also or alternatively be connected to input interface 210).

Figure 2B:
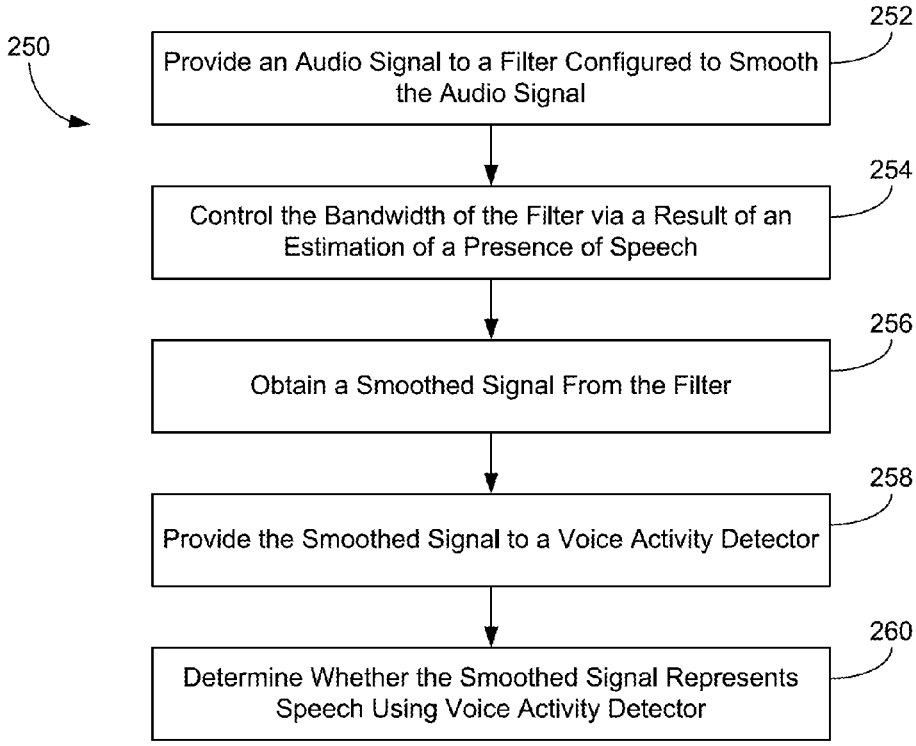
FIG. 2B is a flow chart of a process for using the audio system of FIG. 2A to detect speech, according to an exemplary embodiment.

Referring now to FIG. 2B, a flow chart of a process 250 for using audio system 200 to detect speech is shown, according to an exemplary embodiment. An audio signal may be provided from communications electronics 204 or microphone 206 to a filter configured to smooth the audio signal (step 252). The bandwidth of the filter may be controlled via a result of an estimation of a presence of speech in the audio signal (step 254). Audio system 200 may obtain a smoothed signal from the filter (step 256) and the smoothed signal may be provided to a voice activity detector (VAD) (step 258). Using the VAD, audio system 200 may determine whether the received smooth signal represents speech or not (step 260).

Figure 3A:
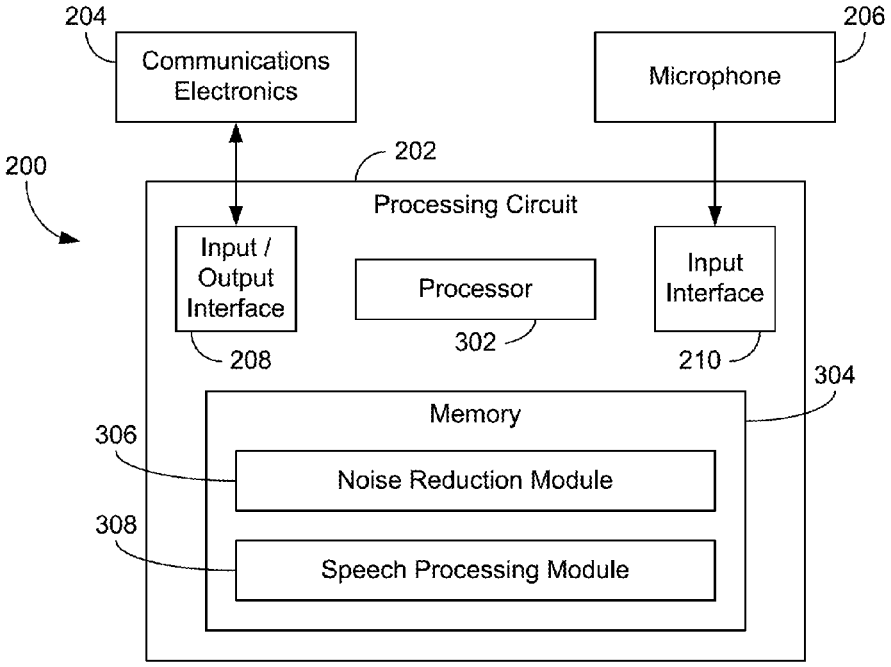
FIG. 3A is a more detailed block diagram of the processing circuit of the audio system of FIG. 2A, according to an exemplary embodiment.

Referring to FIG. 3A, processing circuit 202 of FIG. 2A is shown in greater detail, according to an exemplary embodiment. Processing circuit 202 is shown to include a processor 302 and memory 304. Processor 302 may include a microprocessor, an application specific integrated circuit (ASIC), a circuit containing one or more processing components, a group of distributed processing components, or other hardware configured for processing. Memory 304 can be any volatile or non-volatile memory capable of storing information from the systems and methods of the present disclosure.

Memory 304 may include several modules for executing the steps and methods of the present disclosure. Memory 304 is shown to include a noise reduction module 306 which is configured to accept an audio input and to reduce the noise present in the audio input. Memory 304 is further shown to include a speech processing module 308 which is configured to accept an audio input and to process the audio input to extract and/or process speech.

Figure 3B:
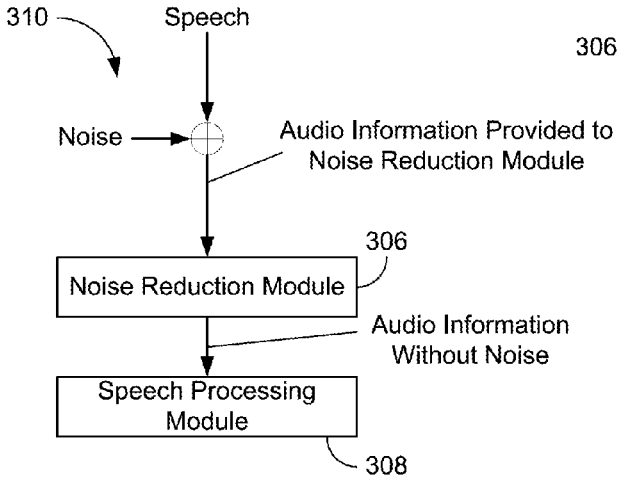
FIG. 3B is a flow chart of a process for processing an audio input, according to an exemplary embodiment.

Referring to FIG. 3B, a flow chart of a process 310 for processing an audio input is shown, according to an exemplary embodiment. Audio information such as speech and noise may be detected and received by a microphone 206. The audio information is received is received such that the audio device cannot detect which audio information is speech and which audio information is noise. The audio information is provided to noise reduction module 306 configured to reduce the noise of the audio information and provide the audio information without the noise (e.g., with reduced noise) to speech processing module 308.

Figure 3C:
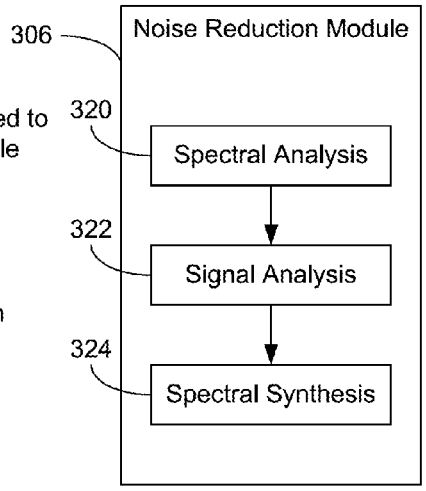
FIG. 3C is a more detailed block diagram of a noise reduction module, according to an exemplary embodiment.

Referring to FIG. 3C, noise reduction module 306 is shown in greater detail. Noise reduction module 306 is shown to include a spectral analysis module (e.g., function, object, etc.) 320, a signal analysis module 322, and a spectral synthesis module 324. Spectral analysis module 320 can be configured to receive an audio input from an audio input device and to deconstruct the received audio input for processing by signal analysis 322. Signal analysis module 322 can be configured to analyze the current audio signal to detect the presence of speech and/or noise (e.g., including estimating the NPSD). Spectral synthesis module 324 can be configured to reconstruct the audio signal with a reduced noise component. Modules 320-324 and/or processes thereof are shown in greater detail in subsequent figures.

Figure 4:
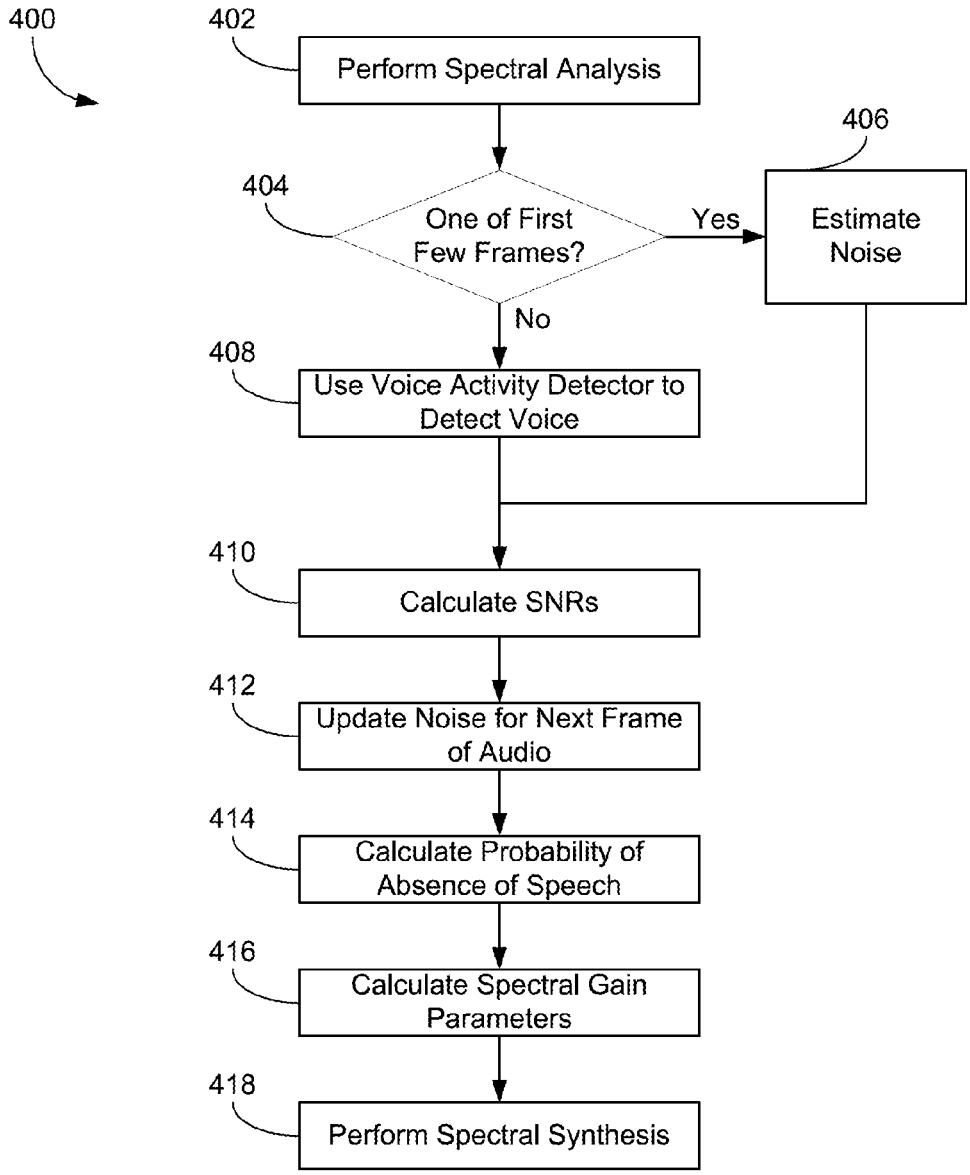
FIG. 4 is a flow chart of a process for noise reduction in an audio signal, according to an exemplary embodiment.

Referring to FIG. 4, a flow chart of a process 400 for reducing noise in an audio signal is shown, according to an exemplary embodiment. Process 400 includes a spectral analysis step (step 402). Spectral analysis step 402 includes receiving a signal and analyzing the signal to smooth the noisy portion of the signal (i.e., the NSPSD) with the first Kalman filter. Spectral analysis is described in greater detail in FIG. 6A.

Process 400 may determine if a particular frame represents one of the first few frames of the signal or not (step 404).

When process 400 is activated and a microphone or other audio input device is activated, a user of the audio input device is usually not talking or otherwise providing an audio input right away (e.g., there is some time delay before an input). Using step 404, process 400 may determine whether a given frame represents this time period. If so, the noise of the current signal may be estimated (step 406). If not, a VAD may be used to detect if there is a voice present in the signal (step 408).

Based on the detection of noise and/or voice in the audio signal, signal-to-noise ratios (SNRs) are calculated for the signal (step 410) According to an exemplary embodiment, a-priori and a-posteriori SNRs may be calculated. An estimated noise is updated (step 412). The updated noise may be used to help determine the noise levels of the next frame or frames of the signal. The noise may be updated using a modified minima-controlled recursive averaging (mMCRA) method (shown in greater detail in FIG. 5B), according to an exemplary embodiment. A probability of the presence or absence of speech in the audio signal may be calculated (step 414). According to an exemplary embodiment, the probability may be calculated at least in part using the a-posteriori SNR determined in step 410. Spectral gain parameters may be calculated (step 416) and applied during spectral synthesis (step 418), which is shown in greater detail in FIG. 7.

Detailed Noise Reduction Algorithm

Figure 5A:
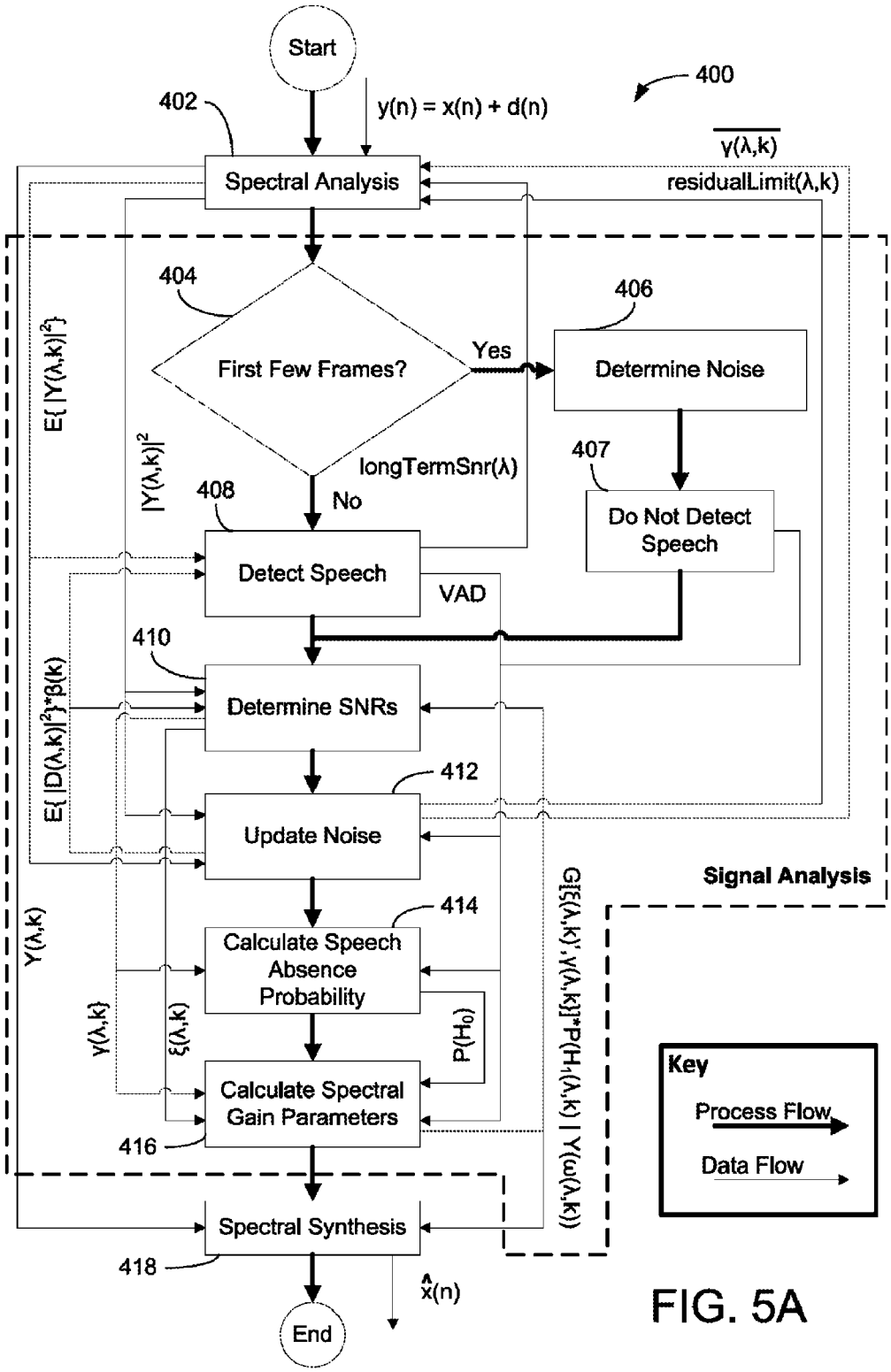
FIG. 5A is a flow chart of the process of FIG. 4 including a data flow, according to an exemplary embodiment.

Referring now to FIG. 5A, a more complex flow chart of process 400 for a noise reduction in an audio signal is shown, according to an exemplary embodiment. In the embodiment of FIG. 5A, a data flow for process 400 is shown. Steps 404-416 may generally correspond with a signal analysis process, according to an exemplary embodiment. The signal analysis process is generally used to estimate a speech component of a signal.

Spectral analysis step 402 may receive a signal y(n) including a speech component x(n) and a noise component d(n) (e.g., y(n)=x(n)+d(n)). Step 402 may additionally include receiving information about a detection of speech from a previous frame (from step 408) about a long-term SNR for the signal (where λ represents the input frame index of the signal), a residual limit (λ,k) from the noise updating of step 412, and an a-posteriori SNR γ(λ,k). Using the inputs, spectral analysis step 402 may analyze and smooth the noise of the audio signal (i.e., the NSPSD). Step 402 may include providing an input to spectral synthesis step 418 for spectral synthesis and for speech detection step 408. Step 402 may provide noisy speech complex power to step 410 for determining the SNRs. Spectral analysis is described in greater detail in FIG. 6A.

If the current frame of the signal is determined to be just noise (steps 404-406), the VAD may not be used and speech may not be detected (step 407). The signal noise information and speech information obtained in steps 404-407 may be used to calculate spectral gain parameters in step 416.

Step 408 of detecting speech or a voice from a signal may include a VAD receiving data relating to a noise estimate ($E\{|(\lambda,k)|^2\}\beta(\lambda,k)$, where β(λ,k) is the frequency dependent noise overestimation factor) from step 412 (i.e., an estimate of the NPSD) and a Kalman smoothed signal $E\{|(\lambda,k)|^2\}$ from the first Kalman filter of spectral analysis step 402. Using the inputs of the noise estimate and the smoothed signal, a determination is made as to whether or not speech is present in the given frame λ of the signal. Additionally, the VAD may keep track of a long term average SNR (longTermSn r(λ)) which may be used for controlling a lower limit for the a-priori SNR and for scaling a maximum residual noise level for the noisy speech Kalman smoothing algorithm of the first Kalman filter (shown in greater detail in FIGS. 6A-D). The detection of speech data determined in step 408 may be provided to spectral analysis step 402 for spectral analysis.

Step 410 of determining the SNRs may include receiving a noisy speech complex power $|(\lambda,k)|^2$ (i.e., a NSPSD estimate) from spectral analysis step 402, a estimated complex magnitude spectrum ($G[(\lambda,k)',\lambda(\lambda,k)]*P(H_1(\lambda,k)|Y(\omega(\lambda,k)))$ from step 416, and a noise estimate (i.e. a NPSD estimate) from step 412. Determining the SNRs may include using the inputs to determine an a-priori SNR and a a-posteriori SNR for use by process 400. For example, the a-posteriori SNR may be used by measurement noise update routine 620 of FIG. 6C.

Step 412 of updating a noise estimate (i.e., an estimate of the NPSD) may include receiving data relating to the presence of voice in the signal from a VAD of step 408. Step 412 may further include receiving noisy speech complex power and the Kalman smoothed signal (i.e., a NSPSD estimate) of the first Kalman filter from spectral analysis step 402. Updating a noise estimate is shown in greater detail in FIG. 5B. Step 412 may provide spectral analysis step 402 with a residual limit for spectral analysis and speech detection step 408 with noise estimate data.

Step 414 of calculating a speech absence probability may include receiving data relating to the presence of voice from step 408 and an a-priori SNR (λ,k) from step 410. Using the SNR and the presence or voice (or lack thereof), a probability $P(H_O)$ of the absence of speech is determined for use in calculating spectral gain parameters.

Step 416 of calculating spectral gain parameters may include receiving data relating to the presence of voice from step 408, a-priori and a-posteriori SNRs from step 410, and a probability $P(H_O)$ of the absence of speech from step 414.

Calculating the spectral gain parameters may be done by using a simplified minimum mean square error short time spectral amplitude (MMSE-STSA) estimator. The estimator tries to estimate the complex magnitude spectrum. According to an exemplary embodiment, a simplified MMSE-STSA estimator may be defined by:

$$G_{simp}(\lambda, k) = \sqrt{\frac{\xi(\lambda, k)}{\xi(\lambda, k)+1}}\,\delta(\lambda, k) + \Omega\frac{\xi(\lambda, k)}{\xi(\lambda, k)+1}\,\frac{(\mathrm{MAX}_{INST} - \delta(\lambda, k))}{\mathrm{MAX}_{INST}}$$

where δ is a hard-limited instantaneous a-priori SNR defined by:

$$\delta(\lambda, k) = \begin{cases} \gamma(\lambda, k) - 1, & \text{if } (\gamma(\lambda, k) - 1 < \mathrm{MAX}_{INST}) \\ \mathrm{MAX}_{INST}, & \text{otherwise} \end{cases}$$

where $\mathrm{MAX}_{INST}$ is the maximum value for the SNR, and Ω is the power spectrum subtraction gain correction factor. Since speech contains pauses and other dead zones, the estimator above can be altered as follows:

$$G_D(\lambda,k)=G_{SIMP}(\lambda,k)P(H_1(\lambda,k)|Y(\lambda,k))$$

where $P(H_1(\lambda,k)|Y(\lambda,k))$ is the probability of speech at a given frequency bin.

Spectral synthesis step 418 may receive an estimated complex magnitude spectrum from step 416 and a converted signal from spectral analysis step 402. Step 418 may use the given data to reconstruct a received signal from the signal analysis process. Step 418 is shown in greater detail in FIG. 7.

Figure 5B:
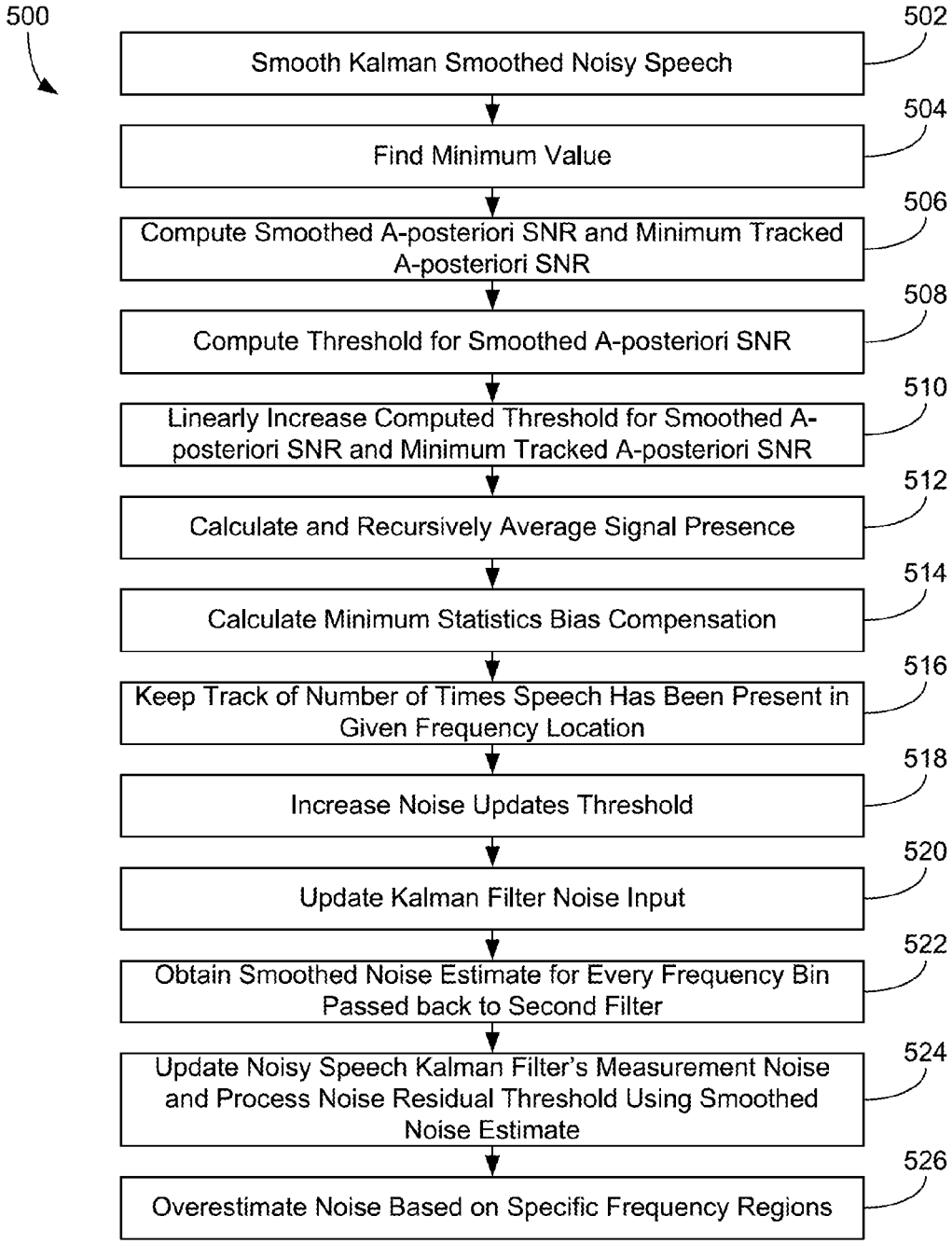
FIGS. 5B-C are flow charts of processes for updating a noise estimate, according to an exemplary embodiment.

Estimating Noise using a Modified Minima-Controlled Recursive Averaging (MCRA) Method Referring now to FIG. 5B, a flow chart of a process 500 for updating a noise estimate (e.g., step 412 of FIG. 4) is shown, according to an exemplary embodiment. The updating may be performed via a modified minima-controlled recursive averaging (MCRA) method. The MCRA method may generally recursively average the noise estimate based on a smoothing parameter that is based on an a-posteriori probability of speech presence.

According to an exemplary embodiment, steps 502-512 generally correspond with a method for searching for a noise floor. As more time passes with the detection of speech, the threshold is continually increased via step 510. The increased threshold helps discover sudden changes in the noise floor more quickly, allowing for a quicker detection of a pause in speech when the pause in speech happens.

The Kalman smoothed noisy speech received from spectral analysis step 402 may be smoothed (step 502). According to an exemplary embodiment, the speech may be smoothed by:

$$S_f(\lambda, k) = \sum_{i=-Lw}^{Lw} w(i)E\{|Y(\lambda, k-i)|^2\}$$

where w is a rectangular window function of size 2Lw+1 and $S_f$ is the frequency smoothed noisy speech. A minimum value $S_f(\lambda,k)$ for a frame 2 is found (step 504). A smoothed a-posteriori SNR $S_r$ and minimum tracked a-posteriori SNR $S_i$ are computed (step 506). $S_r$ is calculated by:

$$S_r(\lambda, k) = \frac{E\{|Y(\lambda, k)|^2\}}{S_{min}(\lambda, k)BIAS_{min}(\lambda, k)}$$

and $S_i$ is calculated by:

$$S_i(\lambda, k) = \frac{|Y(\lambda, k)|^2}{S_{min}(\lambda, k)BIAS_{min}(\lambda, k)}$$

where $BIAS_{min}(\lambda,k)$ is a minimum statistics bias compensation calculated in step 514.

A frequency dependent signal presence threshold $S_{r_nth}$ may be computed for $S_r$ (step 508) and the threshold computed for $S_r$ and $S_i$ may be linearly increased based on the frequency dependent signal presence time (step 510).

A hard-decision signal presence (e.g., either the signal exists or the signal does not exist) may be made and recursively averaged (step 512). The signal presence $p(\lambda,k)$ is determined by:

$$p(\lambda, k) = \begin{cases} 1, \text{ if } ([Sr(\lambda, k) >= \text{Sr_th}(\lambda, k)]||[Si(\lambda, k) >= \text{Si_th}(\lambda, k)]) \\ 0, \text{ otherwise} \end{cases}$$

and the averaging of the signal presence may be calculated using the equation:

$$\hat{p}(\lambda,k)=\alpha_p\hat{p}(\lambda-1,k)+(1-\alpha_p)p(\lambda,k)$$

where $\alpha_p$ is a smoothing constant. According to one exemplary embodiment, the constant may be set to 0.2.

The minimum statistics bias compensation may be calculated (step 514). The bias compensation may be a ratio of the Kalman smoothed noisy speech to the minimum value of step 504 for bins that do not contain speech, and zero for the bins that do contain speech. The bias is smoothed via recursive averaging, according to an exemplary embodiment (e.g., the calculated ratio or zero is recursively averaged into the bias value).

The bias may be calculated by the following ratio:

$$BIAS(\lambda, k) = \begin{cases} \dfrac{\sum_{i=-w}^{w} I_{bias}(\lambda, k)E\{|Y(\lambda, k)|^2\}}{\sum_{i=-w}^{w} I_{bias}(\lambda, k)S_{min}(\lambda, k)}, \text{ if } \left(\sum_{i=-w}^{w} I_{bias}(\lambda, k) \,!= 0\right) \\ 0, \text{ otherwise} \end{cases}$$

where w is the window length and $I_{bias}(\lambda,k)$ is determined by:

$$I_{bias}(\lambda, k) = \begin{cases} 1, \text{ if } (Sr(\lambda, k) <= 4) \\ 0, \text{ otherwise.} \end{cases}$$

$BIAS(\lambda,k)$ may be recursively averaged by the following equation:

$$BIAS_{min}(\lambda,k)=\alpha_{bias}BIAS_{min}(\lambda-1,k)+(1-\alpha_{bias})BIAS(\lambda,k)$$

where $\alpha_{bias}$ is a smoothing constant (e.g., set to 0.95).

If the current frame is a speech frame, process 500 may keep track of the number of times $p_c$ speech has been present at the given frequency location (step 516). $p_c$ is determined by:

$$p_c(\lambda, k) = \begin{cases} p_c(\lambda, k) = p_c(\lambda, k) + 1, \\ \text{if } ((Sr(\lambda, k) >= 2) \;\&\&\; (VAD = \text{true})) \\ 0, \text{ if } (VAD == \text{false}), \\ p_c(\lambda, k), \text{ otherwise.} \end{cases}$$

The Kalman smoothed noise update threshold $S_{r_nth}$ may be increased based on the amount of time speech has been present at the given frequency location (step 518). According to an exemplary embodiment, the increase may be via a constant or multiple. $S_{r_nth}$ may be calculated by:

$$S_{r_nth}(\lambda, k) = \begin{cases} S_{r_nth}(\lambda, k) + 100(64 - (p_c(\lambda, k) - 30))/64, \text{ if } (30 <= p_c(\lambda, k) <= 64) \\ S_{r_nth}(\lambda, k), \text{ if } (64 < p_c(\lambda, k)) \\ 2.734375, \text{ otherwise.} \end{cases}$$

Figure 5C:
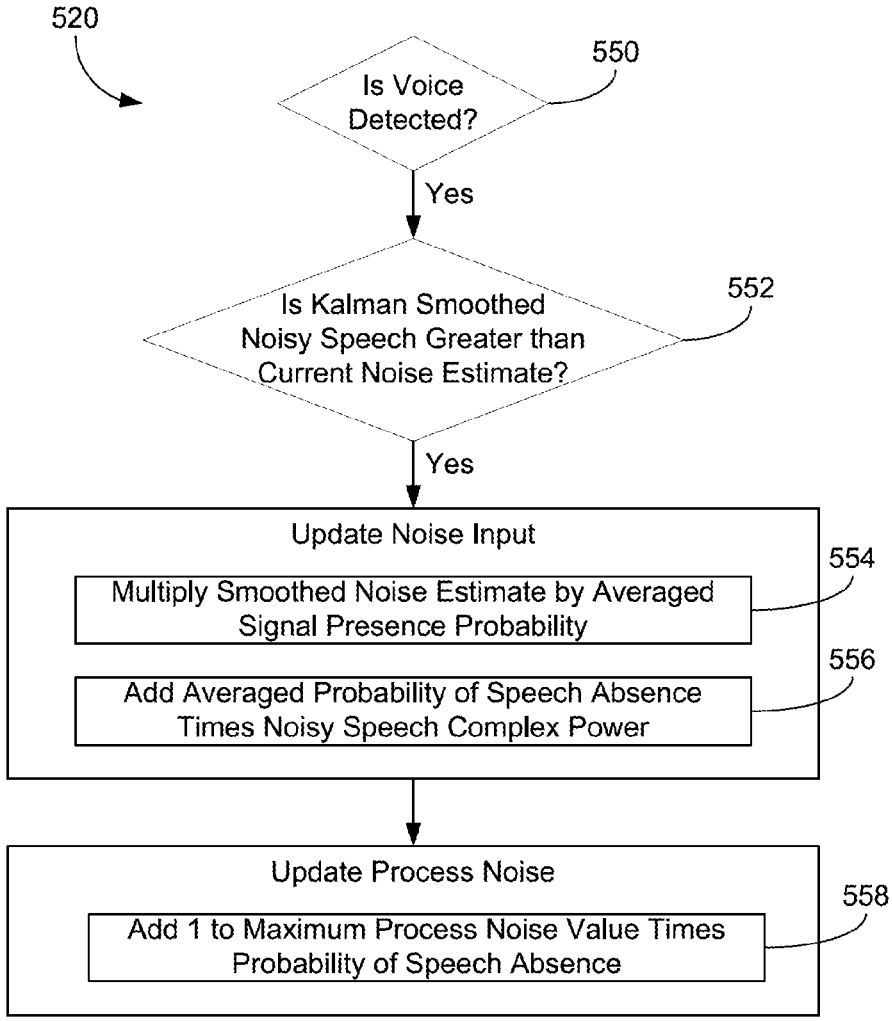

The Kalman filter noise input (for the second Kalman filter) may then be updated using the earlier steps of FIG. 5B (step 520). Referring also to FIG. 5C, step 520 is shown in greater detail. If voice is detected (step 550) and the Kalman smoothed noisy speech is greater than the current noise estimate (step 552) (e.g., $S_r(\lambda,k) \leqq S_{r_nth}(\lambda,k)$, where $S_{r_nth}$ is the threshold from step 518), then the noise input and process noise may be updated. Due to voice suppression of noise, the actual noise floor may be biased to a lower value (e.g, the noise estimate will be biased to a false noise floor). Therefore, the noise input and process noise is only updated when the noisy speech is greater than the current noise estimate.

An estimated noise input $\sigma_n(\lambda,k)$ and process noise $Q_n(\lambda,k)$ are determined. The noise input may be determined by multiplying a smoothed noise estimate by the average signal presence probability (determined at step 512) (step 554) and adding an averaged probability of speech absence (equal to 1 minus the average signal presence probability determined at step 512) times the noisy speech complex power (received at step 502) (step 556). Steps 554-556 are represented by the equation:

$$\sigma_n(\lambda,k)=E\{|D(\lambda,k)|^2\}\hat{p}(\lambda,k)+(1-\hat{p}(\lambda,k))|Y(\lambda,k)|^2.$$

For updating the noise input, as the signal presence probability increases, more weight is given to the previous second Kalman filter output (the smoothed noise estimate).

The process noise may be calculated by adding 1 to the maximum process noise value times the probability of speech absence (step 558). Step 558 is represented by the equation:

$$Q_n(\lambda,k)=1+\mathrm{MAX}_{Q_n}(1-\hat{p}(\lambda,k))$$

As the probability of speech absence increases, the process noise increases.

Referring to step 520, if there is no voice detected, the above equations also hold. Otherwise:

$$\sigma_n(\lambda,k)=E\{|D(\lambda,k)|^2\} \text{ and } Q_n(\lambda,k)=1$$

where the estimated noise input is simply the smoothed noise estimate and the process noise is 1.

The estimated noise input may be Kalman filtered (using the second Kalman filter), having the calculated process noise as an input, to determine the smoothed noise estimate $E\{|D(\lambda,k)|^2\}$ using the above equations (step 522). Using the smoothed noise estimate, the measurement noise and process noise of the first Kalman filter may be updated (step 524)(i.e., $E\{|D(\lambda,k)|^2\}$ is provided to the bandwidth adjustment routine for the first Kalman filter—the Kalman filter that smoothes the noisy portion of the audio signal prior to voice activity detection). Step 524 is shown and described in greater detail in step 644 of FIG. 6D. The noise may be overestimated based on specific frequency regions (step 526). For example, the smoothed noise estimate may be multiplied by a factor $\beta$ (e.g., 1.5, 1.625, 1.75, etc).

Figure 6A:
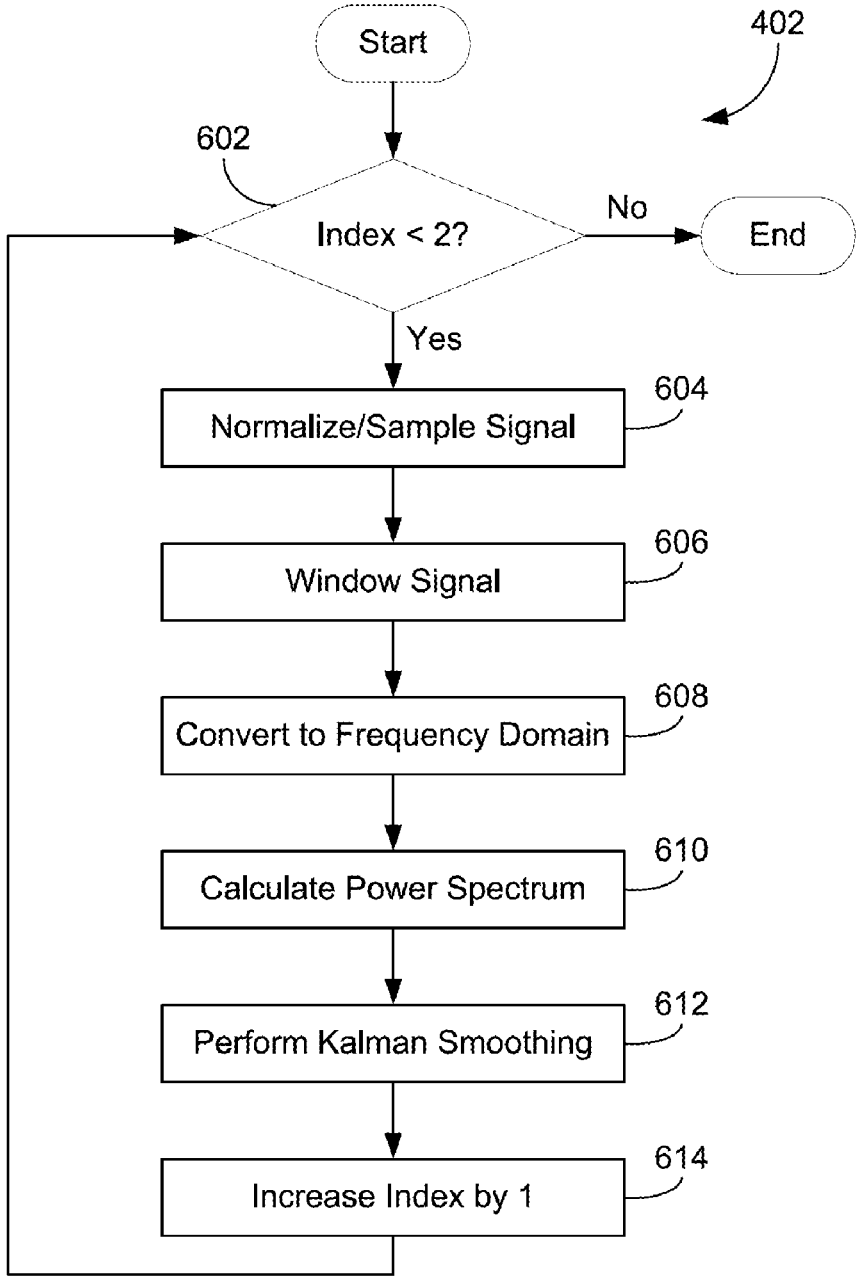
FIG. 6A is a flow chart of a process for spectral analysis, according to an exemplary embodiment.

Referring now to FIG. 6A, a flow chart of a process 600 for spectral analysis (e.g., spectral analysis step 402 of FIG. 4) is shown, according to an exemplary embodiment. Process 600 includes receiving the input noisy speech signal $y(n)=x(n)+d(n)$. According to an exemplary embodiment, the input may be sampled or normalized (step 604) at a rate of $f_s$=8 k and divided into frames of size $M_c$=180 where n is the sampling index, $$f_m = \frac{f_s}{M_c} = 44.44 \text{ Hz}$$

is the frame rate, and $\lambda$ is the input frame index.

The resulting signal y(n) is windowed (step 606) with overlapping frames and converted to the frequency domain (step 608) with a short-time Fourier transform (STFT) given by the equation:

$$Y(\lambda_{SA}, k) = \sum_{l=0}^{L-1} y(\lambda_{SA} * M_E + l)h(l)e^{-j2\pi kl/L}$$

where $\lambda_{SA}$ is the spectral analysis frame index, k is the frequency index, $M_E$ is the frame step which is equal to 90 samples or $M_c/2$, and h is the analysis window.

Due to the linearity property of the STFT, the noise is also additive in the frequency domain, resulting in the signal:

$$Y(\lambda_{SA},k)=X(\lambda_{SA},k)+D(\lambda_{SA},k)$$

and expressed in polar form:

$$Y(\lambda_{SA},k)=R(\lambda_{SA},k)e^{j\theta\theta Y(\lambda_{SA},k)}$$

$$X(\lambda_{SA},k)=A(\lambda_{SA},k)e^{j\theta\theta X(\lambda_{SA},k)}$$

where R and A are the magnitudes of the noisy speech and clean speech and $\theta_Y$ and $\theta_X$ are the respective phases.

The power spectrum is calculated (step 610) and Kalman smoothing is performed (step 612) using the first Kalman filter. Kalman smoothing for the first Kalman filter is described in greater detail in FIGS. 6C-D.

For process 600, on every input frame $\lambda$, process 600 is performed twice. After two consecutive iterations, the spectral analysis operation finishes and the resulting signals are sent onto the signal analysis and spectral synthesis sections of the system where the signals are processed at the input frame rate $f_m$.

Figure 6B:
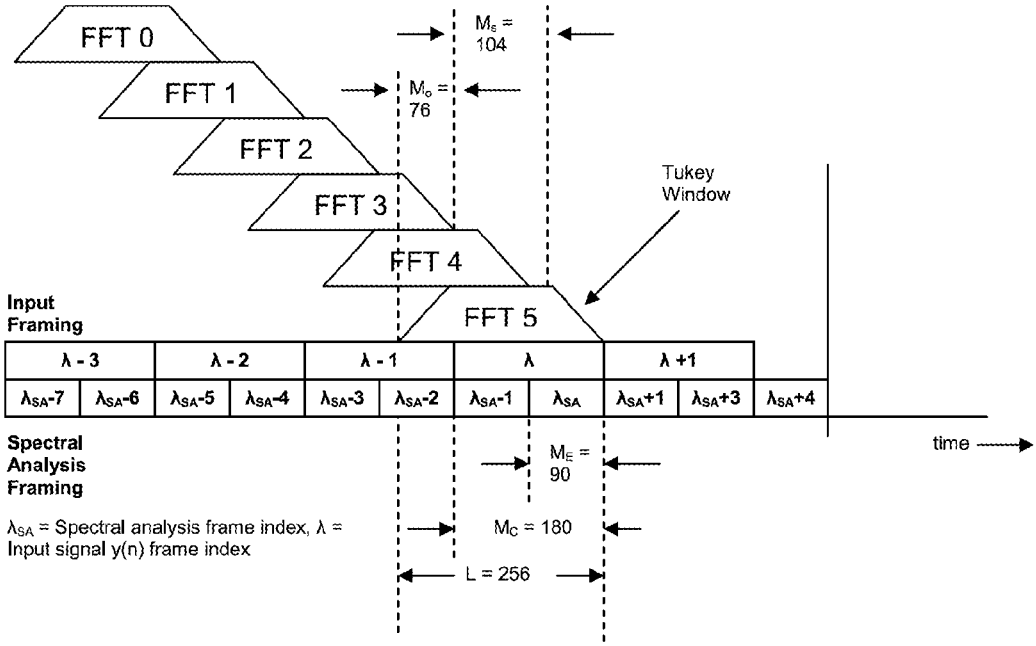
FIG. 6B is a graph of a spectral analysis frame alignment, according to an exemplary embodiment.

Referring also to FIG. 6B, according to an exemplary embodiment, spectral analysis process 600 may run two times faster than the input frame rate $f_m$, allowing the first Kalman filter to adapt to sudden changes in the input signal (e.g., transitioning from a speech frame to a noise frame). FIG. 6B generally shows a frame alignment configuration for handling multiple frames of an input signal for spectral analysis process 600. According to an exemplary embodiment, the frame alignment is a Fast Fourier Transform (FFT) frame alignment.

Kalman Smoothing

Figure 6C:
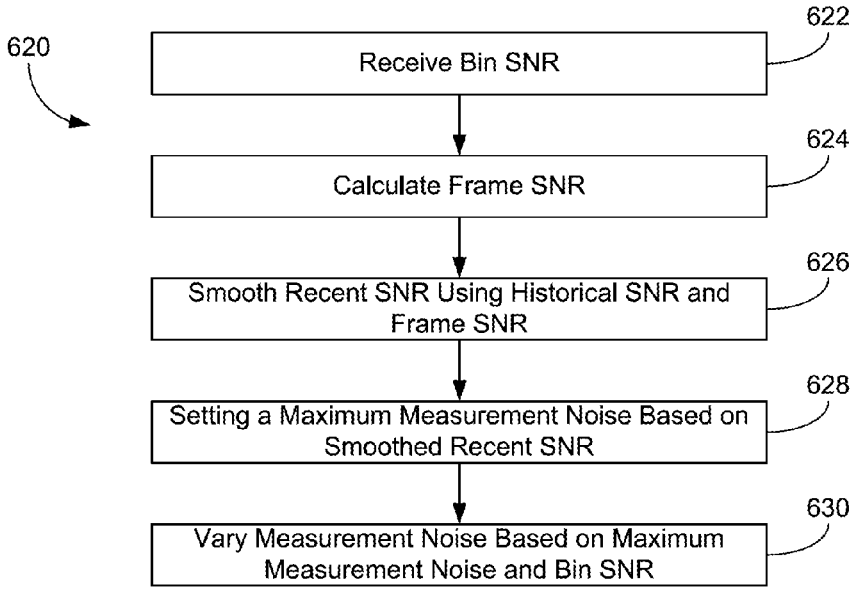
FIG. 6C is a flow chart of a process for a measurement noise update for Kalman smoothing, according to an exemplary embodiment.
Figure 6D:
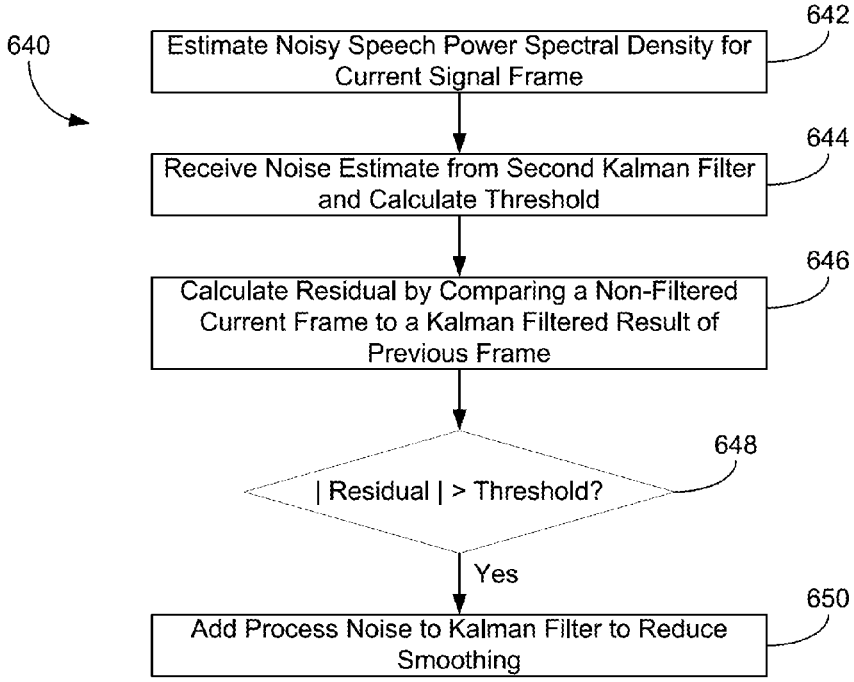
FIG. 6D is a flow chart of a process for a process noise update for Kalman smoothing, according to an exemplary embodiment.

Referring also to FIGS. 6C-D, flow charts of processes 620, 640 for Kalman smoothing (i.e., the smoothing of spectral analysis step 402 of FIG. 4 and Kalman smoothing step 612 of FIG. 6A) are shown, according to an exemplary embodiment. The bandwidth of the first Kalman filter may be controlled by adjusting the measurement noise (process 620) and the process noise (process 640) provided to the first Kalman filter. More specifically, measurement noise provided to the first Kalman filter may be adjusted based on observed SNR behavior and process noise $Q(\lambda,k)$ provided to the first Kalman filter may be adjusted.

Adjusting the Measurement Noise Provided to the First Kalman Filter

Referring more specifically to FIG. 6C, the measurement noise update routine 620 may include receiving the bin SNR $Sr(\lambda,k)$ (step 622). According to an exemplary embodiment, the bin is a frequency bandwidth of a FFT frame alignment (e.g., the FFT frame alignment as shown in FIG. 6B). The SNR is a smoothed a-posteriori SNR determined by and received from step 410 of FIG. 4, according to an exemplary embodiment. The frame SNR may be calculated (step 624). The frame SNR may be averaged in frequency over time to determine a long term SNR. The long term SNR may be an instantaneously smoothed SNR.

The recent SNR of step 624 may be smoothed using historical SNR data and frame SNR data (step 626). A maximum measurement noise may be set based on the smoothed recent SNR (step 628) and the measurement noise may be varied based on the maximum measurement noise and bin SNR (step 630). If the measurement noise is reduced (e.g., the SNR is high), the bandwidth of the first Kalman filter may be increased and the amount of smoothing provided by the first Kalman filter may be reduced. If the measurement noise is increased (e.g., the SNR is low) to reduce the bandwidth of the first Kalman filter, the smoothing provided by the first Kalman filter is increased.

Referring further to FIG. 6C, for controlling the measurement noise via the steps of process 620, R may be controlled via the following equations:

$$\sigma(\lambda) = \begin{cases} \mathrm{MAX}_{LONGSNR}, \text{ if } (longTermSnr(\lambda) > \mathrm{MAX}_{LONGSNR}) \\ longTermSnr(\lambda), \text{ otherwise} \end{cases}$$

$$\eta(\lambda) = \frac{(\mathrm{MAX}_{LONGSNR} - \sigma(\lambda))\mathrm{MAX}_{MEAS}}{\mathrm{MAX}_{LONGSNR}}$$

$$\gamma_{smooth}(\lambda, k) = \begin{cases} \mathrm{MAX}_{SNR}, \text{ if } (Sr(\lambda, k) > \mathrm{MAX}_{SNR}) \\ Sr(\lambda, k), \text{ otherwise} \end{cases}$$

$$\psi(\lambda, k) = \frac{(\mathrm{MAX}_{SNR} - \gamma_{smooth}(\lambda, k)) * \eta(\lambda)}{\mathrm{MAX}_{SNR}}$$

$$R(\lambda, k) = R(\lambda - 1, k) * \alpha R + (1 - \alpha R) * \psi(\lambda, k)$$

$$R(\lambda, k) = \begin{cases} R(\lambda, k), \text{ if } (R(\lambda, k) > \mathrm{MIN}_{MEAS}) \\ \mathrm{MIN}_{MEAS}, \text{ otherwise} \end{cases}$$

where $\mathrm{MAX}_{SNR}$ is the maximum value of Sr(λ,k), $\mathrm{MAX}_{MEAS}$ and $\mathrm{MAX}_{MIN}$ are the maximum value and minimum value of the measurement noise, longTermSnr is the recursively averaged frame SNR (e.g., the average SNR over the time in which speech is present) as determined in step 624, $\mathrm{MAX}_{LONGSNR}$ is the maximum value of the long term SNR, and αR is the recursive smoothing factor. R varies when longTermSnr and Sr(λ,k) vary. In other words, measurement noise R is adjusted to account for changes in the long term SNR over time to ensure minimum smoothing during periods of high SNR relative to long term SNR. The measurement noise may be varied via longTermSnr in order to ensure minimum amounts of smoothing during periods of high SNR.

Adjusting the Process Noise Provided to the First Kalman Filter

For controlling the process noise of the first Kalman filter, changes from a noise frame to a speech frame may not be accurately tracked by a conventional zero-order filter. During the transitions, if changes from a noise frame to a speech frame are not accurately tracked, a Kalman filter used for smoothing noise can "diverge" further from tracking the input signal.

A routine to adaptively control the process noise of the first Kalman filter may be used to solve this divergence issue. More particularly, process noise may be used to determine how certain the process is of the signal. For example, as the process noise increases, the first Kalman filter trusts the input signal more and the filters less, and as the process noise decreases, trusts the input signal less and filters more. Process noise may be added based on a threshold calculated from the average complex noise variance $E\{|D(\lambda_{SA},k)|^2\}$ (i.e., the smoothed noise estimate $E\{|D(\lambda,k)|^2\}$ calculated in step 522 of FIG. 5B by the second Kalman filter). Generally, if the first Kalman filter residual (i.e., the difference between the filtered bin and the non-filtered bin) exceeds the threshold, additional process noise is added. Process noise can be continuously added for each spectral analysis subframe $\lambda_{SA}$ while the residual remains above the threshold, and the process noise is set back to its original value when the residual drops below the threshold.

Process noise provided to the first Kalman filter can more particularly be adjusted according to the following algorithm: If the residual of the Kalman filtered frequency bin (i.e., the difference between the filtered bin and the non-filtered bin) is larger than a threshold (e.g., a threshold number of noise variances), then additional process noise is added to the first Kalman filter. A residual greater than the threshold can mean that the first Kalman filter is incorrectly modeling the signal. Therefore, additional process noise is added to alert the filter as to the uncertainty of the correctness of the model. Additional process noise is added as long as the residual remains above the threshold; if the residual falls below the threshold, it is set back to its original value.

Referring now to FIG. 6D, process noise update routine 640 may include estimating a NSPSD for the current signal frame (step 642). A noise estimate can be received (e.g., from process 500 of FIG. 5B) from the second Kalman filter and a threshold may be calculated (step 644). Step 644 may correspond with step 524 of the mMCRA method of FIG. 5B. According to an exemplary embodiment, the threshold may be calculated by multiplying the noise variance estimate (i.e., the smoothed noise estimate $E\{|D(\lambda,k)|^2\}$ calculated in step 522 of FIG. 5B by the second Kalman filter) by a scalar for each individual frequency bin (e.g., $D_k$*X where $D_k$ is the estimate and X is the scalar). The calculated threshold allows for controlling the number of noise variances the residual of the first Kalman filter can diverge before adding extra process noise to the Kalman filter.

A residual may be calculated by comparing a non-filtered current frame to a Kalman filtered result of the previous frame (step 646). If the absolute value of the residual is greater than the threshold of step 644 (step 648), process noise may be added to the first Kalman filter (step 650) to reduce the smoothing of the signal. According to an exemplary embodiment, the process noise may be increased linearly, adding a predetermined constant value to the process noise.

The zero-order scalar form of the Kalman-filtering equation of the first Kalman filter is generally given by:

$$\hat{X}(\lambda_{SA},k)=\hat{X}(\lambda_{SA-1},k)+K(\lambda_{SA},k)*[Z(\lambda_{SA},k)-\hat{X}(\lambda_{SA-1},k)]=E\{|Y(\lambda_{SA},k)|^2\}$$

where $\hat{X}$ is the Kalman estimate of the noiseless signal X based on the observed noisy signal Z. $[Z(\lambda_{SA},k)-\hat{X}(\lambda_{SA-1},k)]$ is the residual. K is the Kalman gain and controls the amount of filtering applied to input signal Z. When K is small, the filter "trusts" the input signal Z less and previous estimate $\hat{X}$ more, and when K is big, vice versa. The Kalman gain is computed using a scalar form of the Riccati equations given by:

$$M(\lambda_{SA},k)=P(\lambda_{SA-1},k)+Q(\lambda_{SA},k)$$

$$K(\lambda_{SA},k)=M(\lambda_{SA},k)/[M(\lambda_{SA},k)+R(\lambda,k)]$$

$$P(\lambda_{SA},k)=M(\lambda_{SA},k)-K(\lambda_{SA},k)*M(\lambda_{SA},k)$$

where P is the covariance which represents errors in $\hat{X}$ (e.g., the variance of $(X-\hat{X})$) after updating the Kalman gain, M is the covariance representing errors in $\hat{X}$ before updating the Kalman gain, R is the variance of the white measurement noise v (e.g., $E(V^2)$ and unlike the other parameters is updated at the input frame rate λ), and Q is the process noise scalar (e.g., $E(W^2)$ where W is the process noise). As R gets larger, K decreases causing the filter bandwidth to narrow. Similarly, as Q gets smaller, K gets smaller causing the bandwidth to decrease.

Since the noise estimate is based on spectral minima tracking and the VAD needs to detect the onset of a speech frame, the Kalman smoothing algorithm should follow the spectral peaks and valleys of speech. Therefore, the bandwidth should be increased at the onset of a speech frame and kept low during periods of speech activity. During periods of speech, the bandwidth should be increased such that variations are followed. The bandwidth should be lowered during speech pause so that the noise power can be estimated. Therefore, in order to estimate the two states, R and Q are varied to control the amount of smoothing and for tracking errors.

Spectral Synthesis

Figure 7:
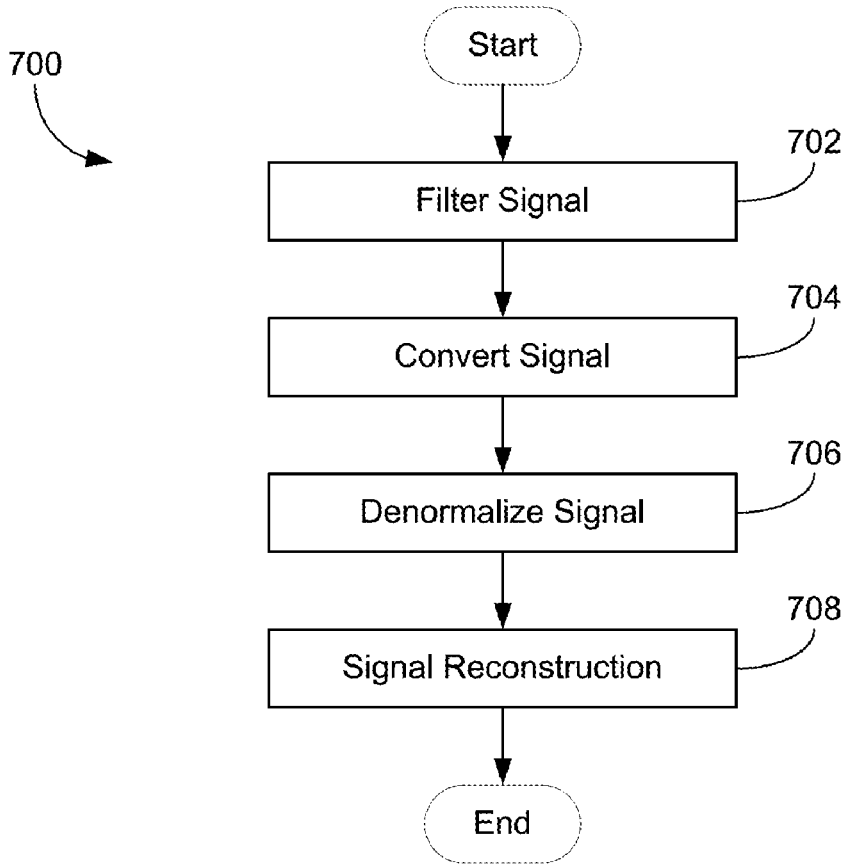
FIG. 7 is a flow chart of a process for spectral synthesis, according to an exemplary embodiment.

Referring to FIG. 7, a flow chart of a process 700 for spectral synthesis (e.g., step 418 of FIG. 4) is shown, according to an exemplary embodiment. The original noisy complex signal $Y(\lambda,k)$ is filtered (step 702) using a spectral gain function (e.g., a function derived under speech presence uncertainty as determined in the signal analysis steps of process 400). For example, the function may be:

$$\hat{X}(\lambda,k)=Y(\lambda,k)*G_{simp}(\lambda,k)P(H_1(\lambda,k)|Y(\lambda,k))$$

where $G_{simp}$ is a spectral gain function (e.g., a simplified MMSE-STSA spectral gain function), $P(H_1(\lambda,k)|Y(\lambda,k))$ is the probability of speech presence (e.g., a-posteriori probability of speech presence), and $\xi$ and $\gamma$ are the a-priori and a-posteriori SNRs. The filtered signal is then converted using an inverse STFT (step 704) and windowed. The signal is further denormalized (step 706), and the resulting time domain signal is reconstructed using an overlap-add method (step 708).

According to an exemplary embodiment, spectral analysis process 600 may run two times as fast as spectral synthesis process 700. Therefore, every other filtered spectral analysis STFT is used in reconstructing the signal during process 700. Referring also to FIG. 6B, frames FFT 3 and FFT 5 are shown overlapping by $M_O$=76 samples and would be used in process 700. During the overlap-add section, the 76 overlapping samples are added together and appended with the $M_S$=104 non-overlapping samples of FFT 5. The resulting clean speech sequence $\hat{x}(n)$ is of the same duration as the original input signal y(n); however, the sequence is delayed by $M_O$ samples.

While the exemplary embodiments illustrated in the figures and described herein are presently preferred, it should be understood that the embodiments are offered by way of example only. Accordingly, the present application is not limited to a particular embodiment, but extends to various modifications that nevertheless fall within the scope of the appended claims.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

The invention claimed is:

1. An apparatus for detecting speech in an audio signal obtained from an input device, the audio signal including speech and noise, the apparatus comprising:

a processing circuit comprising a filter configured to smooth the audio signal, the processing circuit configured to control the bandwidth of the filter based on characteristics of the audio signal and to provide a smoothed signal obtained from the filter to a voice activity detector configured to determine whether the smoothed signal represents speech, wherein the filter is a Kalman filter, wherein the processing circuit is configured to decrease the bandwidth of the Kalman filter when the audio signal is estimated to have a low signal to noise ratio.

2. The apparatus of claim 1, wherein the processing circuit is configured to adjust the bandwidth of the Kalman filter by adjusting a measurement noise parameter of the Kalman filter.

3. The apparatus of claim 2, wherein the processing circuit is further configured to reduce the measurement noise parameter to increase the bandwidth of the Kalman filter and to reduce the amount of smoothing provided by the Kalman filter when a recent signal to noise radio is high relative to historic signal to noise information.

4. The apparatus of claim 2, wherein the processing circuit is further configured to increase the measurement noise parameter to reduce the bandwidth of the Kalman filter and to increase the amount of smoothing provided by the Kalman filter when a recent signal to noise ratio is low relative to historical signal to noise information.

5. An apparatus for detecting speech in an audio signal obtained from an input device, the audio signal including speech and noise, the apparatus comprising:

a processing circuit comprising a filter configured to smooth the audio signal, the processing circuit configured to control the bandwidth of the filter based on characteristics of the audio signal and to provide a smoothed signal obtained from the filter to a voice activity detector configured to determine whether the smoothed signal represents speech, wherein the filter is a Kalman filter, wherein the processing circuit is configured to increase the bandwidth of the Kalman filter when the audio signal is estimated to have a high signal to noise ratio.

6. The apparatus of claim 5, wherein the processing circuit is configured to decrease the bandwidth of the Kalman filter when the audio signal is estimated to have a low signal to noise ratio.

7. An apparatus for detecting speech in an audio signal obtained from an input device, the audio signal including speech and noise, the apparatus comprising:

a processing circuit comprising a filter configured to smooth the audio signal, the processing circuit configured to control the bandwidth of the filter based on characteristics of the audio signal and to provide a smoothed signal obtained from the filter to a voice activity detector configured to determine whether the smoothed signal represents speech, wherein the filter is a first Kalman filter, wherein the processing circuit is further configured to receive a noise estimate from a second Kalman filter and to calculate a threshold;

wherein the processing circuit is further configured to calculate a residual by comparing a non-filtered current frame to a Kalman filtered result of a previous frame;

wherein the processing circuit is further configured to determine whether the residual is greater than a threshold; and wherein the processing circuit is further configured to add process noise to the first Kalman filter when the residual is greater than the threshold in order to reduce the amount of smoothing.

8. The apparatus of claim 7, wherein the processing circuit is configured to decrease the bandwidth of the Kalman filter when the audio signal is estimated to have a low signal to noise ratio.

9. A method for detecting speech in an electronic audio signal obtained from an input device, the electronic audio signal including speech and noise, the method comprising:

providing the electronic audio signal to a filter configured to smooth the audio electronic signal;

controlling the bandwidth of the filter based on characteristics of the electronic audio signal; and obtaining an electronic smoothed signal from the filter and providing the electronic smoothed signal to a voice activity detector configured to determine whether the electronic smoothed signal represents speech using an electronic circuit, wherein the filter is a Kalman filter, wherein the bandwidth of the Kalman filter is decreased when the electronic audio signal is estimated to have a low signal to noise ratio.

10. The method of claim 9, wherein the bandwidth of the Kalman filter is increased when the electronic audio signal is estimated to have a high signal to noise ratio.

11. A method for detecting speech in an electronic audio signal obtained from an input device, the electronic audio signal including speech and noise, the method comprising:

providing the electronic audio signal to a filter configured to smooth the electronic audio signal;

controlling the bandwidth of the filter based on characteristics of the electronic audio signal; and obtaining an electronic smoothed signal from the electronic filter and providing the electronic smoothed signal to a voice activity detector configured to determine whether the electronic smoothed signal represents speech using an electronic circuit, wherein the filter is a Kalman filter, wherein the bandwidth of the Kalman filter is increased when the electronic audio signal is estimated to have a high signal to noise ratio.

12. The method of claim 11, wherein the bandwidth of the Kalman filter is decreased when the electronic audio signal is estimated to have a low signal to noise ratio.

13. The method of claim 12, wherein the bandwidth of the Kalman filter is varied by adjusting a measurement noise parameter of the Kalman filter.

14. A method for detecting speech in an audio signal obtained from an input device, the electronic audio signal including speech and noise, the method comprising:

providing the electronic audio signal to a filter configured to smooth the electronic audio signal;

controlling the bandwidth of the filter based on characteristics of the electronic audio signal; and obtaining an electronic smoothed signal from the filter and providing the electronic smoothed signal to a voice activity detector configured to determine whether the electronic smoothed signal represents speech using an electronic circuit, wherein the filter is a Kalman filter, wherein the bandwidth of the Kalman filter is varied by adjusting a measurement noise parameter of the Kalman filter; and reducing the measurement noise parameter to increase the bandwidth of the Kalman filter and to reduce the amount of smoothing provided by the Kalman filter when a recent signal to noise ratio is high relative to historical signal to noise information.

15. A method for detecting speech in an electronic audio signal obtained from an input device, the electronic audio signal including speech and noise, the method comprising:

providing the electronic audio signal to a filter configured to smooth the electronic audio signal;

controlling the bandwidth of the filter based on characteristics of the electronic audio signal; and obtaining an electronic smoothed signal from the filter and providing the electronic smoothed signal to a voice activity detector configured to determine whether the electronic smoothed signal represents speech using an electronic circuit, wherein the filter is a Kalman filter, wherein the bandwidth of the Kalman filter is varied by adjusting a measurement noise parameter of the Kalman filter; and increasing the measurement noise parameter to reduce the bandwidth of the Kalman filter and to increase the amount of smoothing provided by the Kalman filter when a recent signal to noise ratio is low relative to historical signal to noise information.

16. A method for detecting speech in an electronic audio signal obtained from an input device, the electronic audio signal including speech and noise, the method comprising:

providing the electronic audio signal to a filter configured to smooth the electronic audio signal;

controlling the bandwidth of the filter based on characteristics of the electronic audio signal; and obtaining an electronic smoothed signal from the filter and providing the electronic smoothed signal to a voice activity detector configured to determine whether the electronic smoothed signal represents speech using an electronic circuit, wherein the filter is a first Kalman filter, wherein the bandwidth of the first Kalman filter is varied by adjusting a measurement noise parameter of the first Kalman filter;

receiving a noise estimate from a second Kalman filter and calculating a threshold, and calculating a residual by comparing a non-filtered current frame to a Kalman filtered result of a previous frame;

determining whether the residual is greater than a threshold; and adding process noise to the first Kalman filter when the residual is greater than the threshold in order to reduce the amount of smoothing.

17. A computer program product comprising a non-transistory machine readable medium having computer readable program code embodied therein, the computer readable program code adapted to be executed to implement steps comprising:

obtaining an electronic audio signal from an input device, the electronic audio signal including speech and noise;

providing the electronic audio signal to a filter configured to smooth the electronic audio signal;

controlling the bandwidth of the filter based on characteristics of the electronic audio signal;

obtaining an electronic smoothed signal from the filter and providing the electronic smoothed signal to a voice activity detector configured to determine whether the electronic smoothed signal represents speech, wherein the filter is a Kalman filter, and wherein the bandwidth of the Kalman filter is varied by adjusting a measurement noise parameter of the Kalman filter, wherein the steps further comprise:

reducing the measurement noise parameter to increase the bandwidth of the Kalman filter and to reduce the amount of smoothing provided by the Kalman filter when a recent signal-to-noise ratio is high relative to historical signal to noise information; and increasing the measurement noise parameter to reduce the bandwidth of the Kalman filter and to increase the amount of smoothing provided by the Kalman filter when a recent signal to noise ratio is low relative to historical signal to noise information.

18. The computer program product of claim 17, wherein the a noise estimate is provided by a second Kalman filter.

19. The computer program product of claim 18, wherein the steps are for performance in a noise reduction module.

20. The computer program product of claim 19, wherein the steps further comprise:

receiving a noise estimate from a second Kalman filter and calculating a threshold, and calculating a residual by comparing a non-filtered current frame to a Kalman filtered result of a previous frame;

determining whether the residual is greater than a threshold; and adding process noise to the Kalman filter when the residual is greater than the threshold in order to reduce the amount of smoothing.

* * * * *